United States Patent [19]

Sandow

[11] Patent Number: 5,052,164

[45] Date of Patent: Oct. 1, 1991

[54] METHOD FOR MANUFACTURING A PANEL ASSEMBLY AND STRUCTURE RESULTING THEREFROM

[75] Inventor: Kiyoshi Sandow, Crosby, Tex.

[73] Assignee: Plasteco, Inc., Houston, Tex.

[21] Appl. No.: 400,514

[22] Filed: Aug. 30, 1989

[51] Int. Cl.[5] ..... E04C 2/54

[52] U.S. Cl. ..... 52/790; 52/306; 52/309.1; 52/406; 52/481

[58] Field of Search ..... 52/790, 306, 307, 309.1, 52/200, 406, 481, 788

[56] References Cited

U.S. PATENT DOCUMENTS

| | | | |
|---|---|---|---|
| D. 196,778 | 11/1963 | Keller | D13/1 |
| D. 198,259 | 5/1964 | Keller | D13/1 |
| D. 199,524 | 11/1964 | Keller | D13/1 |
| D. 199,525 | 11/1964 | Keller | D13/1 |
| 1,734,685 | 11/1929 | Mays et al. | 52/481 |
| 1,799,400 | 4/1931 | Tucker | 52/481 X |
| 2,691,292 | 10/1954 | Roberts | 52/306 |
| 2,994,413 | 8/1961 | Levy et al. | 52/481 X |
| 3,037,590 | 6/1962 | Pavlecka | 52/481 |
| 3,082,848 | 3/1963 | Keller . | |
| 3,082,849 | 3/1963 | Keller . | |
| 3,146,155 | 8/1964 | Trenner | 52/309.1 X |
| 3,308,593 | 3/1967 | Smith | 52/456 |
| 3,314,846 | 4/1967 | Niwa | 52/406 X |
| 3,469,362 | 9/1969 | La Tart | 52/481 X |
| 3,563,577 | 2/1971 | Wittenmayer | 52/481 X |
| 4,132,218 | 1/1979 | Bennet | 126/270 |
| 4,164,830 | 8/1979 | Bierlich | 52/398 |
| 4,223,493 | 9/1980 | Moench et al. | 52/200 |
| 4,315,962 | 2/1982 | Skoien | 52/406 X |
| 4,335,551 | 6/1982 | Benkelman et al. | 52/200 |
| 4,557,090 | 12/1985 | Keller | 52/245 |
| 4,567,710 | 2/1986 | Reed | 52/790 |
| 4,608,796 | 9/1986 | Shea | 52/399 |
| 4,754,592 | 7/1988 | Moench et al. | 52/790 |
| 4,850,167 | 7/1989 | Beard et al. | 52/200 |

FOREIGN PATENT DOCUMENTS

| | | | |
|---|---|---|---|
| 225444 | 11/1959 | Australia | 52/306 |
| 0150534 | 1/1984 | European Pat. Off. | 52/309.1 |
| 2722817 | 11/1978 | Fed. Rep. of Germany | 52/309.1 |
| 3011905 | 10/1980 | Fed. Rep. of Germany | 52/788 |
| 1485237 | 5/1967 | France | 52/309.1 |
| 2508555 | 12/1982 | France | 52/200 |

OTHER PUBLICATIONS

Kalwell Corporation brochure-"The most highly insulating light transmitting system for walls, window walls, window replacement."

Excerpts from "Architectural Guidebook LEXAN Sheet".

*Primary Examiner*—John E. Murtagh

*Assistant Examiner*—Deborah McGann Ripley

*Attorney, Agent, or Firm*—Pravel, Gambrell, Hewitt, Kimball & Krieger

[57] ABSTRACT

A method for manufacturing an improved transparent panel assembly for fabricating wall and roofing components. The method includes the extrusion of a top and bottom member made of transparent plastic material. Each extruded member includes a top and bottom sheet with interspersed ribs for structural integrity. Each extruded member is supported in spaced relationship by a plurality of beam structures having longitudinal axes substantially normal with the direction of the internal ribs of the extruded panel members. The structure resulting from the improved method includes top and bottom panel members having internal ribs molded in an integral manner, and an elongated support structure mounted between the panel members in a direction substantially normal with the longitudinal axis of the internal ribs.

11 Claims, 4 Drawing Sheets

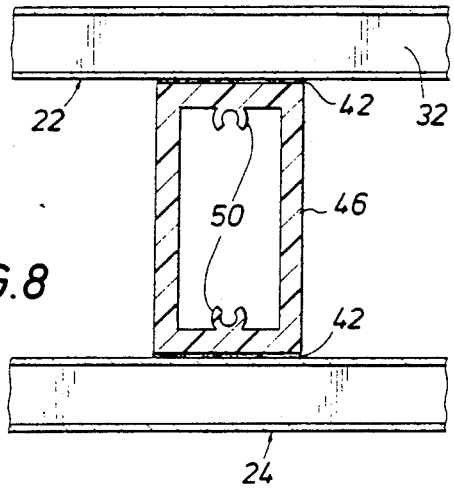
FIG.8
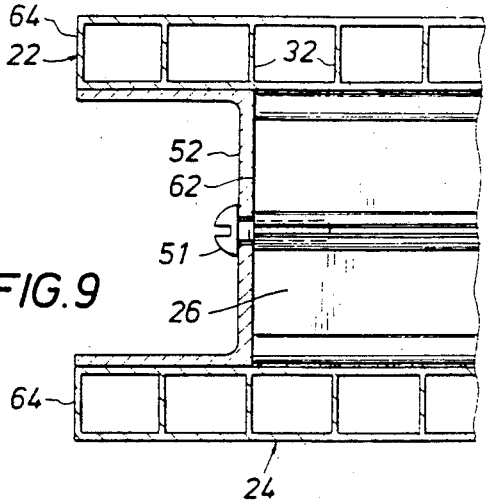
FIG.9
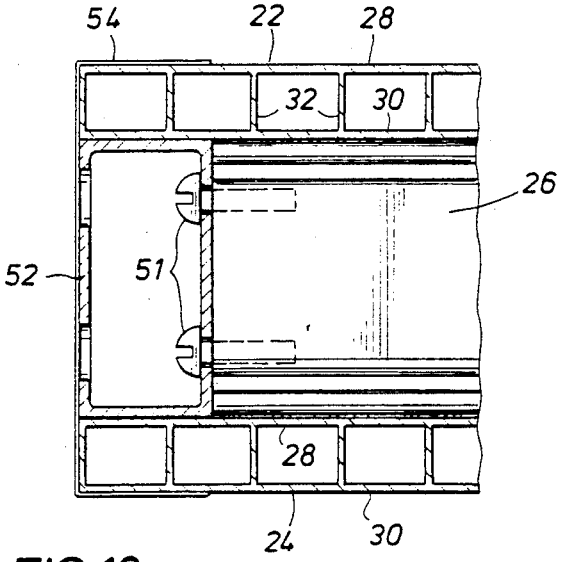
FIG.10
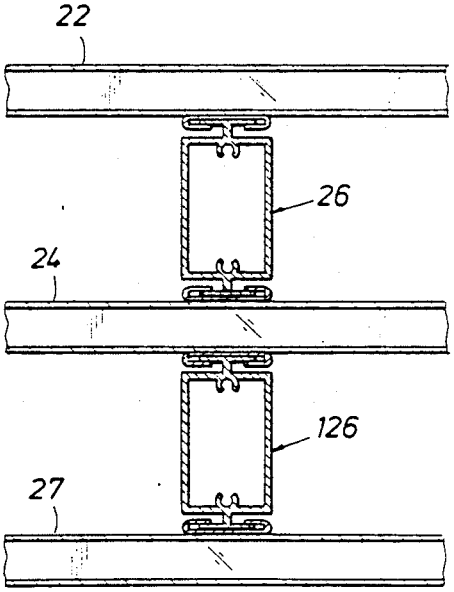
FIG.11
FIG.12
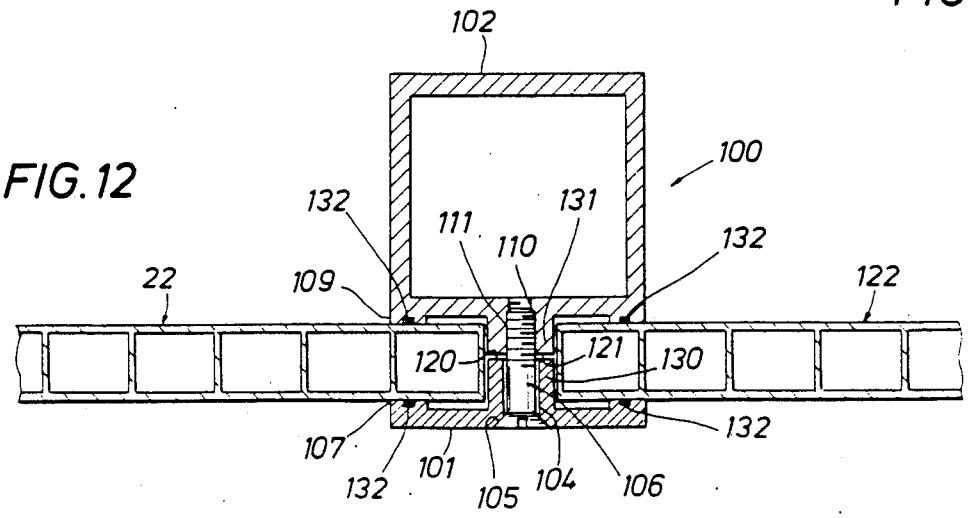

METHOD FOR MANUFACTURING A PANEL ASSEMBLY AND STRUCTURE RESULTING THEREFROM

BACKGROUND OF THE INVENTION

1. Field of the Invention

This invention relates to an improved method for manufacturing a panel assembly having superior insulation and structural integrity characteristics, and the structure resulting therefrom. More particularly, this invention relates to a substantially light transmitting-translucent panel assembly with superior insulation and rigidity properties.

2. Description of the Prior Art

Due to the cost of construction, an improved panel assembly having light transmitting combined with low heat transmittance properties for the manufacturer of walls and roofs is desirable. Furthermore, it is particularly advantageous for such panel assembly units to be prefabricated and quickly assembled on site. Such panel assemblies should preferably exhibit superior insulation qualities, light weight as well as structural integrity, which minimizes the amount of field time required to install the structure in the field. Such panel assemblies should also be available in large sizes which minimizes the amount of installation time.

The use of multi-pane or multi-glaze panels is well known (see, for example, U.S. Pat. Nos. 4,567,710; 4,754,592; 4,608,796; 4,164,830; and 3,308,593). However, such references disclose the use of complex grids between the composite pieces of glass to provide rigidity. Such references do not, however, disclose a method for manufacturing a simple and improved panel which substantially reduces the amount of hardware between the glass panes. Furthermore, such references do not disclose or even suggest using the equivalent of the glass structure to increase the rigidity or structural integrity of the unit.

Various other references disclose the use of multi-segmented wall panels; however, they are complex and cumbersome (see, for example, U.S. Pat. Nos. 3,082,848; 3,082,849; and 4,557,090; and U.S. Pat. Nos. 196,778; 198,259; 199,524; and 199,525).

Consequently, there is a need for an improved panel assembly which is transparent, rigid, and easily manufactured and installed.

SUMMARY OF THE INVENTION

Briefly, the invention relates to an improved method for manufacturing a light transmitting panel assembly and the structure resulting therefrom. The panel assembly is manufactured by extruding two plate members, each having a top and bottom sheet and a series of vertical ribs which contact the top and bottom sheets and maintain the sheets in spaced relationship. The ribs are extruded substantially parallel with the direction of extrusion. The top and bottom sheets and the ribs are manufactured as a single piece of a transparent material such as a thermoplastic. Thermoplastic is available in clear or colored, transparent color or translucent or opaque colors. A plurality of elongate support structures are then attached between the first and second plates in a direction substantially normal with the longitudinal axis of the ribs. In this manner, there is no need for bracing in a direction perpendicular to the support structures since the ribs, which are an integral part of the plate members, perform that function. The support structures may have an I-beam cross-sectional arrangement or they may have another cross-sectional configuration such as rectangular, square or other shapes which provide adequate support and stiffness in a direction substantially normal with the direction of the interspersed ribs.

Additional plate members may be manufactured in a similar manner and supported in a spaced and parallel relationship with the first two plate members by adding additional support structures between the additional plate member and the adjacent plate member.

Examples of the more important features of this invention have been summarized rather broadly in order that the detailed description may be better understood. There are, of course, additional features of the invention which will be described hereafter and which also form the subject of the claims appended hereto.

BRIEF DESCRIPTION OF THE DRAWINGS

In order to more fully understand the drawings used in the detailed description of the invention, a brief description of each drawing is provided.

FIGS. 4–8 are a cross-sectional elevation views of the present invention showing various alternate embodiments of a portion of the present invention.

FIGS. 9–10 are cross-sectional elevation views of two end portions of the present invention.

FIG. 11 is an elevation view of an alternate embodiment of the present invention.

FIG. 12 is a cross-sectional plan view of the present invention showing means for connecting two panels.

DETAILED DESCRIPTION OF THE INVENTION

Figure 1:
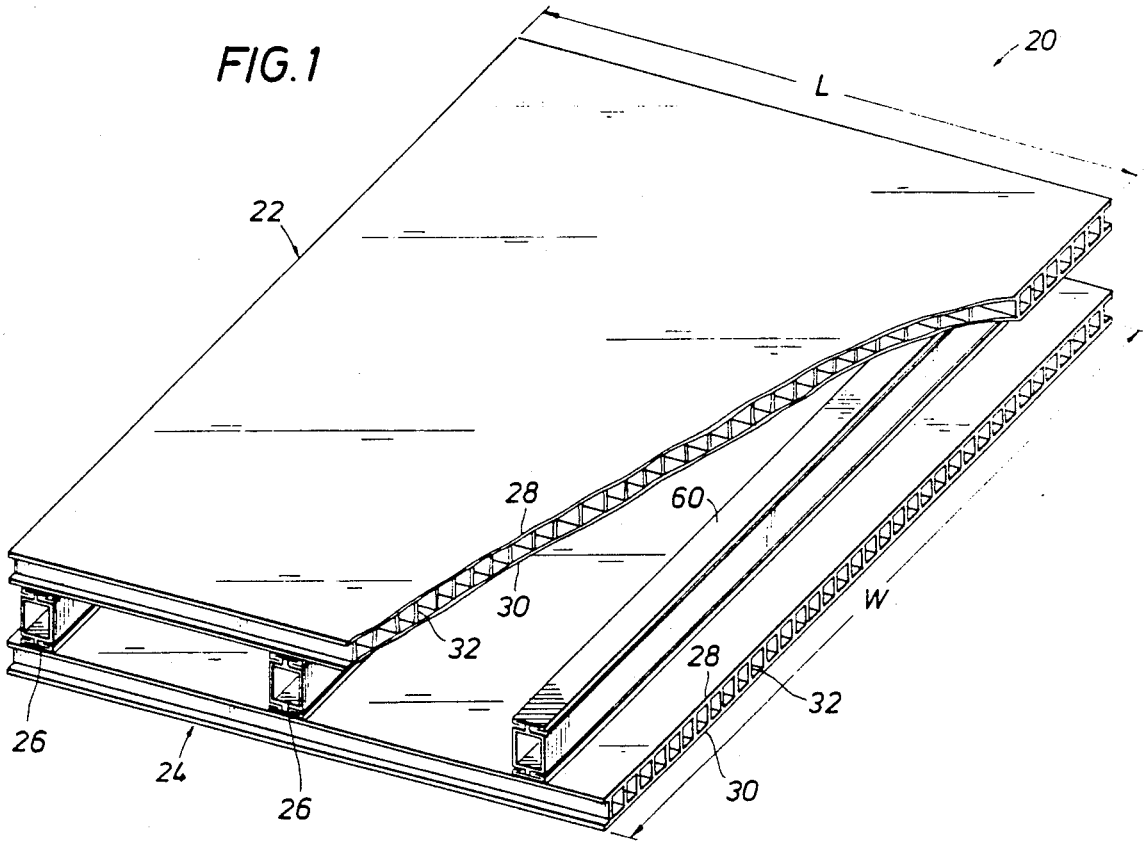
FIG. 1 is a perspective view, partially removed, of the invention.
Figure 2:
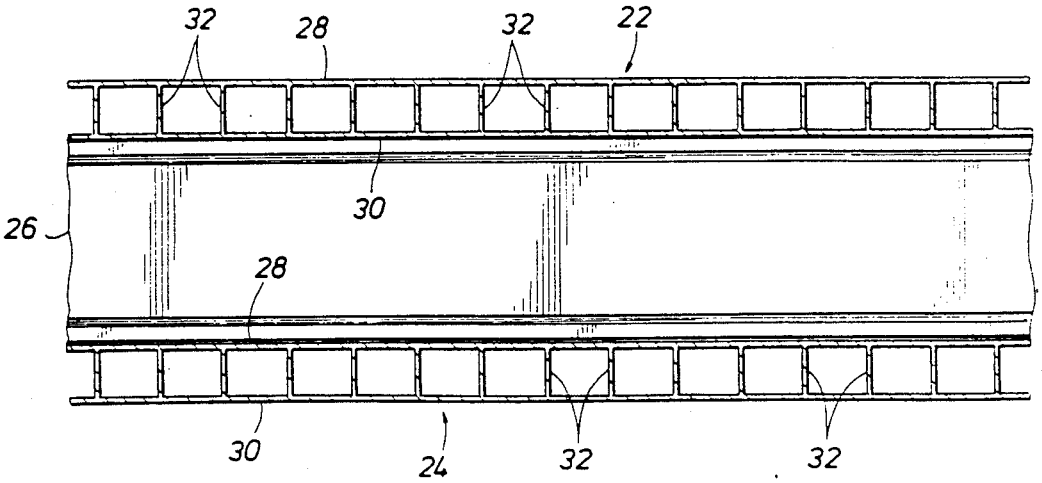
FIG. 2 is an elevation view of the present invention.
Figure 3:
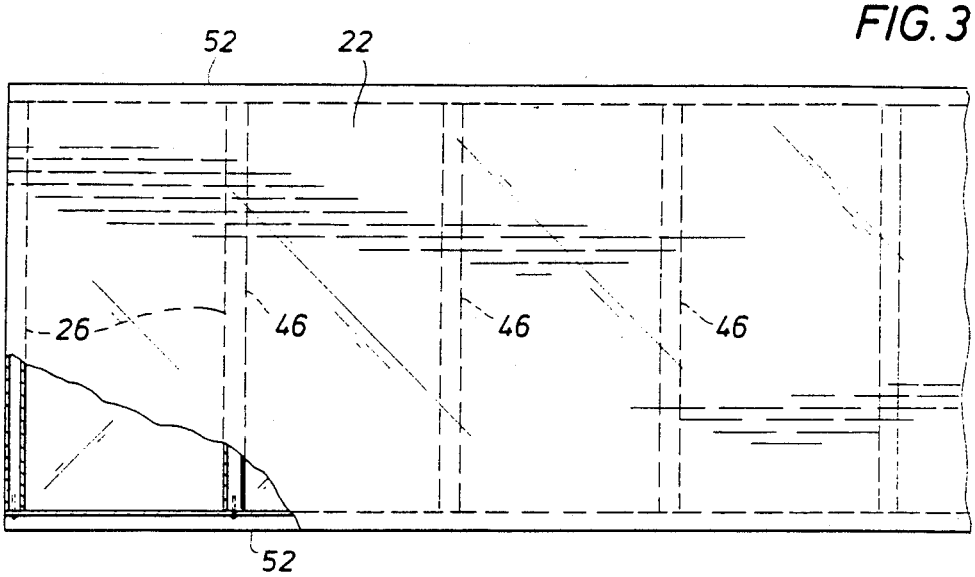
FIG. 3 is a top plan view of the present invention.

Referring to FIGS. 1–3, a panel assembly 20 is shown which comprises plate members 22, 24. Plate members 22, 24 are assembled in a substantially parallel relationship as shown and spaced apart by elongate support structure 26. Each plate member 22, 24 comprises a first or top sheet 28 and a second or bottom sheet 30. First and second (or top and bottom) sheets 28, 30 are held in a substantially parallel spaced relationship as shown by ribs 32. The support structures 26 may comprise a number of cross-sectional configurations as discussed in more detail below. Referring still to FIG. 1, the top 60 of the support structure 26 is attached to the bottom or second sheet 30 of plate member 22. Similarly, the bottom of support structure 26 is attached to the first or top sheet 28 of plate member 24.

In manufacturing the plate members 22, 24, it is preferable that each member be extruded as a single piece. That is, the first and second (or top and bottom) sheets 28, 30 are extruded from a single die at the same time that ribs 32 are extruded. In this manner, each plate member may be extruded in a integral manner. The plates 22, 24 are molded in such a manner that the ribs 32 are extruded in a direction longitudinal to the axis of extrusion.

Once the support members 26 are attached to the plate members 22, 24, the panel assembly 20 is a rigid structure since lateral support in a direction perpendicular to the support structures is provided by the ribs 32 which are an integral part of each plate member. In effect, the ribs 32 acts as lateral beam supports between the support structures 26.

Figure 4:
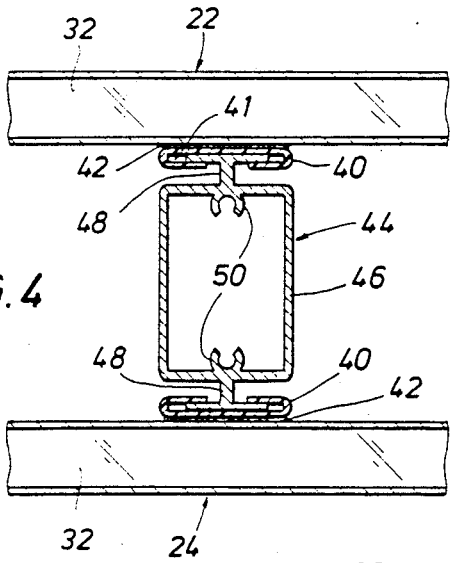
Figure 5:
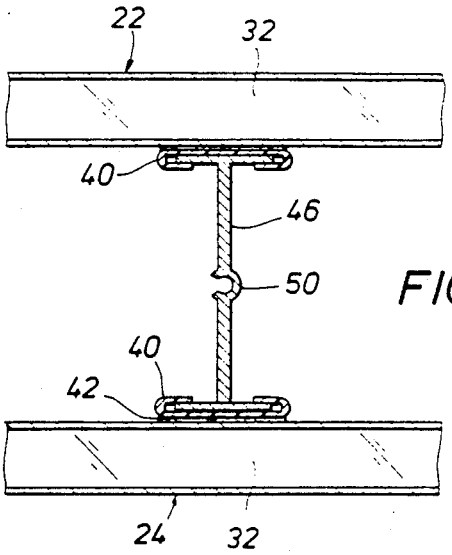

Referring now to FIGS. 4–8, a number of various cross-sectional support structures are shown. In the case of FIGS. 4–5, a C-channel 40 is attached to the plate member by an adhesive 42 or solvent bonded. As shown in FIG. 4, the principal support member 44 comprises a box-shaped or rectangular tubular structure 46 having top and bottom T-sections 48. The T-portions of each T-section are inserted within C-channels 40. Thus, the principal support member 44 is generally restrained by the T-section. Preferably, a small space 41 is provided for slight lateral movement of the T-section within the C-section to accommodate any difference in thermal expansion and contraction characteristics between the two materials (particularly if the support structure 26 is made of aluminum and the C-section of plastic) and to accommodate fabrication tolerances in production. Each support structure in FIGS. 4–7 includes an inlet 50 which serves as a female end for a tap screw 51 (see FIGS. 9–10). The tap screw is used to secure an edge cap 52 as discussed in more detail below.

Referring to FIG. 5, the principal support structure 46 comprises an I-beam section having top and bottom flanges which engage within C-channels 40 of FIG. 5. Again, the I-beam serves the same function as the principal support structure 46 of FIG. 4.

Figure 6:
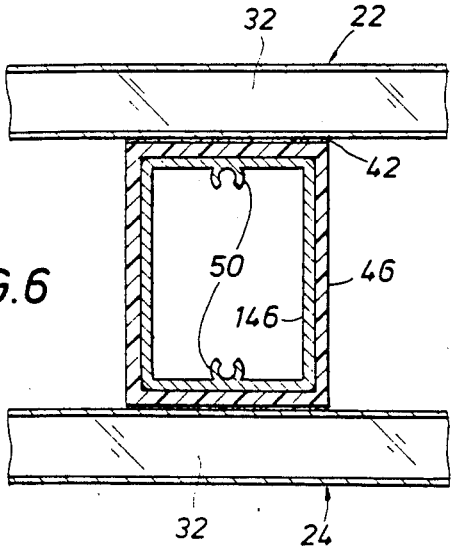

Referring now to FIG. 6, the principal support structure comprises an outer tubular structure 46 which is attached at the top and bottom portions by an adhesive 42 to the plate members 22, 24. The tubular structure 46 includes an inner tubular member 146 onto the female screw inlets 50 are molded. The inner member 146 may be inserted for additional strength.

Figure 7:
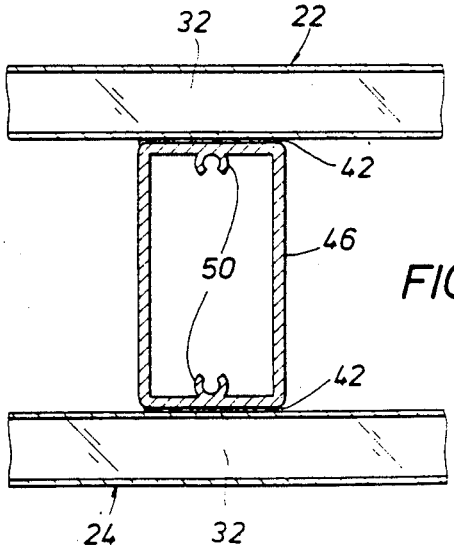

Referring now to FIG. 7, the elongate tubular structure 46 is illustrated again attached by adhesive 42 to plate members 22, 24. In this embodiment the tubular structure 46 includes female screw inlets 50 which are an integral part thereof. FIG. 8 is similar to the embodiment shown in FIG. 7 except that the tubular structure 46 is thicker in size which would be the case if the tubular were manufactured of plastic or other equivalent material. In the case of FIGS. 4–7, such support structures are typically manufactured of aluminum.

Referring now to FIGS. 9–10, preferably each support structure 26 would not extend to the edge of the plate members 22, 24. Rather, the edge 62 of the support structure 26 would be recessed a predetermined distance from the edge 64 of the plate members 22, 24, typically one to two inches. This is preferably for manufacturing and assembly reasons. However, since the plate members 22, 24 would be manufactured typically of a thermoplastic, it is preferable to support the edge of each plate member to avoid damage, particularly during assembly on site. In this manner, an edge cap 52 is inserted and tap screws 51 are used to attach the edge cap 52 to the support structure 26 using female screw inlets 50. It may be advantageous to place a piece of strong adhesive tape 54 across the edge of the assembled panel and allow it to overlap a short distance onto top sheet 28 of plate member 22 and onto bottom sheet 30 of plate member 24. Thus, the edge is sealed from moisture, insects and other foreign debris. The edge cap 52 may be a rail which runs the entire length of plate members 22, 24.

Figure 13:
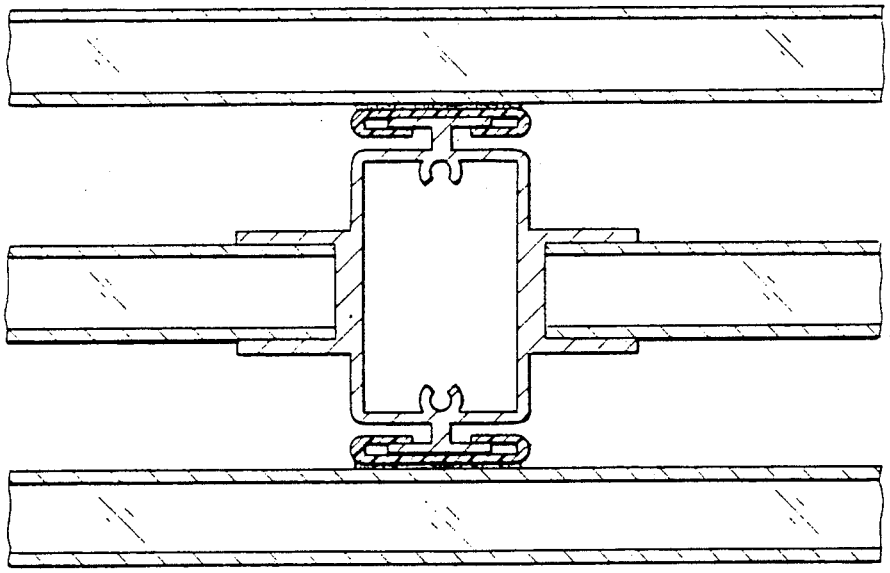
FIG. 13 is an elevation view of yet another embodiment of the present invention.

FIG. 11 illustrates an alternate embodiment of the present invention wherein three plate members 22, 24, 27 are assembled in a manner similar to that discussed above with support structures 26, 126 between each plate member. FIG. 13 illustrates a similar alternate embodiment of the present invention wherein three plate members are supported in spaced relationship by a support structure.

Referring now to FIG. 12, a clamp 100 is illustrated which is used to attach adjacent plate members 22, 122. Clamp 100 comprises a T-element 101 and a tubular member 102. The T-element includes an aperture 104 with a tapered portion 105 for receiving a screw or other fastener 106. The T-member 101 also includes a step portion 107 which is adapted to contact plate members 22, 122. The T-member further includes an extended portion 130 which extends between the plate members 22, 122. The tubular member 102 includes a similar step portion 109 also adapted to contact the plate members 22, 122. Gaskets 132 are provided within step portions 107 and 109 which serve to seal the plate members 22, 122 against the clamp 100. Clamp 100 further includes an aperture 110 having a threaded portion 111 adapted to engage the threads of fastener 106. The tubular member 102 also includes an extended portion 131 which also extends between the plate members 22, 122 and is adapted to contact extended portion 130 of T-member 101.

In the operation of clamp 100, the apertures 104, 110 of T-section 101 and tubular member 102, respectively, are aligned and a fastener 106 is inserted. The fastener is tightened until the edge 120 of extended portion 130 of T-section 101 and the edge 121 of extended portion 131 of tubular member 102 contact. Further compression is thereby prohibited. The lengths of extended portion 130 and extended portion 131 are selected so that upon engagement via the rotation of fastener 106, gaskets 132 of step portions 107, 109 engage the plate members 22, 122 in a tight and compressive manner but do not compress it excessively thereby avoiding any damage to the plate members 22, 122.

In the manufacture of the panel assembly, plate members 22, 24 are molded using state-of-the-art extrusion molding techniques. Each plate member is manufactured to a predetermined width and length. Once extruded, the panels are assembled by attaching the plate members 22, 24 via the support structures 26 at the manufacturing site and shipped in preselected shapes and sizes to a construction site. Once on location, the individual panel assemblies may be then assembled onto various roof and wall components. For example, the clamp as shown in FIG. 12 may be used to attach adjacent panel members.

The manufacture of a panel assembly as described herein provides rigidity across the width W (see FIG. 1) of the panel assembly and yet needed flexibility along the length L of the assembly. This structural characteristic is provided because the support members 26 are perpendicular to the ribs 32. Before the present invention, state-of-the-art panels provided an integral grid system in both directions rather than a single direction as in the present invention because state-of-the-art techniques do not employ an internal structure within each glass which provides support in an orientation perpendicular with the principal support.

The present invention has been described in terms of particular embodiments. Obviously, modifications and alterations of these embodiments will be apparent to those skilled in the art in view of this disclosure. It is, therefore, intended that all such equivalent modifications and variations fall within the spirit and scope of the present invention as claimed.

I claim:

1. A light transparent panel assembly for fabricating wall and roof units, intended to exhibit superior insulation characteristics, said light transparent panel assembly comprising:

first and second light transparent plate members;

means for supporting said first and second light transparent plate members in a substantially parallel and spaced relation;

each said light transparent plate member comprising top and bottom sheets and a plurality of substantially parallel ribs, each said rib attached to said top and bottom sheets; and said support means comprising at least two support structures, each said support structure having top and bottom surfaces with said top surface in bearing contact with said bottom sheet of said first light transparent plate member and with said bottom surface of said support structure in bearing contact with said top sheet of said second light transparent plate member, wherein said support structures are substantially perpendicular to said ribs.

2. The light transparent panel assembly of claim 1, wherein said first and second light transparent plate members are adhesively bonded to said support structures.

3. The light transparent panel assembly of claim 1, wherein said first and second light transparent plate members are solvent bonded to said support structures.

4. The light transparent panel assembly of claim 1, wherein said first and second light transparent plate members are each made out of a single piece of thermoplastic.

5. The light transparent panel assembly of claim 1, further comprising:

an edge cap which attaches to said support structures and is substantially parallel to said ribs and substantially perpendicular to said support structures.

6. The light transparent panel assembly of claim 5, wherein each said support structure has a screw inlet at each end of said support structure and said edge cap has an opening corresponding to said screw inlet so that said edge cap is attached to said support structure by inserting a screw through the opening and into said screw inlet.

7. A light transparent panel assembly for fabricating wall and roof units, intended to exhibit superior insulation characteristics, said light transparent panel assembly comprising:

first and second light transparent plate members;

means for supporting said first and second light transparent plate members in a substantially parallel and spaced relation;

each such light transparent plate member comprising top and bottom sheets and a plurality of substantially parallel ribs, each rib attached to said top and bottom sheets; and said support means comprising (a) at least two support structures, each said support structure having a top and bottom surface wherein said support structures are substantially perpendicular to said ribs, and (b) means for slidably securing said top and bottom surfaces to said first and second light transparent plate members.

8. The light transparent panel assembly according to claim 7, wherein said means for slidably securing comprises a plurality of C-channels attached to said bottom sheet of said first light transparent plate member and to said top sheet of said second light transparent plate member so that said top and bottom surfaces of said support structures slidably engage within said C-channels thereby securing said support structures to said light transparent plate members.

9. The light transparent panel assembly of claim 8, wherein each said support structure has a top and bottom T-section which slidably engage within said C-channels.

10. A light transparent panel assembly for fabricating wall and roof units, intended to exhibit superior insulation characteristics, said light transparent panel assembly comprising:

first and second light transparent plate members made out of a thermoplastic material;

means for supporting said first and second light transparent plate members in a substantially parallel and spaced relation;

each said light transparent plate member comprising top and bottom sheets and a plurality of substantially parallel ribs, each said rib attaching to said top and bottom sheets;

said means for supporting comprising a plurality of support structures, each said support structure having top and bottom surfaces with said top surface in bearing contact with said bottom sheet of said first light transparent plate member and with said bottom surface in bearing contact with said top sheet of said second plate member, wherein said support structures are substantially perpendicular to said ribs; and an edge cap which attaches to said support structures and is substantially parallel to said ribs and substantially perpendicular to said support structures.

11. The light transparent panel assembly of claim 10, wherein each said support structure has a screw inlet at each end of said support structure and said edge cap has an opening corresponding to said screw inlet so that said edge cap is attached to said support structure by inserting a screw through the opening and into said screw inlet.

* * * * *